US009439463B1

(12) United States Patent
Spears

(10) Patent No.: US 9,439,463 B1
(45) Date of Patent: Sep. 13, 2016

(54) COMBINATION PILLOW/BLANKET/PONCHO TRAVEL ACCESSORY

(71) Applicant: Sylvia Spears, Atmore, AL (US)

(72) Inventor: Sylvia Spears, Atmore, AL (US)

( * ) Notice: Subject to any disclaimer, the term of this patent is extended or adjusted under 35 U.S.C. 154(b) by 339 days.

(21) Appl. No.: 14/077,260

(22) Filed: Nov. 12, 2013

Related U.S. Application Data

(60) Provisional application No. 61/727,024, filed on Nov. 15, 2012.

(51) Int. Cl.
*A41D 15/04* (2006.01)
*A41D 3/08* (2006.01)

(52) U.S. Cl.
CPC ..... *A41D 15/04* (2013.01); *A41D 3/08* (2013.01)

(58) Field of Classification Search
CPC ..... A41D 3/08; A41D 15/04
USPC ..... 2/69.5, 79, 94, 85, 54, 92
See application file for complete search history.

(56) References Cited

U.S. PATENT DOCUMENTS 5,649,658 A * 7/1997 Hoffman ..... A45F 3/04 190/2
5,815,833 A * 10/1998 Kuo ..... A41D 15/04 2/69.5
5,884,331 A 3/1999 Barajas
6,275,993 B1 * 8/2001 McCarley ..... A41D 15/04 2/209.11
6,845,518 B1 * 1/2005 Boesen ..... A41D 3/04 2/86
6,851,127 B1 * 2/2005 Khan ..... A41D 13/00 2/84
8,225,442 B2 * 7/2012 Davis ..... A41D 1/205 5/485
8,464,374 B1 6/2013 Thayer
2005/0262634 A1 12/2005 Gottlieb
2008/0235848 A1 10/2008 Wilder et al.
2010/0059558 A1 3/2010 Robinson et al.
2012/0144550 A1 6/2012 Nejad

* cited by examiner

*Primary Examiner* — Robert J Hicks
*Assistant Examiner* — Timothy K Trieu
(74) *Attorney, Agent, or Firm* — George L Williamson

(57) ABSTRACT

A system for a travel accessory being a combination blanket/poncho/pillow that includes a blanket having a hood storable in a pocket on the back thereof and having arm slits/straps so that the blanket can be placed about the shoulders of a user and used either as substantially a blanket or substantially a poncho with the hood being placed over the head of the user. Also included is an accessory pack organizer for storing items therein along with a pillow having carrying handles and back straps wherein the combination system can be carried about by the user. Also shown is a feature wherein a decorative item can be placed on the upper front portion of the hood so that the decorative item can be prominently displayed on the top of the head of the user.

18 Claims, 4 Drawing Sheets

COMBINATION PILLOW/BLANKET/PONCHO TRAVEL ACCESSORY

RELATION TO PREVIOUS APPLICATIONS

This application claims benefit of U.S. Provisional Patent Application having Ser. No. 61/727,024 filed on Nov. 15, 2012.

BACKGROUND OF THE INVENTION

1. Field of the Invention

The present invention relates generally to travel accessories and, more particularly, is concerned with a combination pillow/blanket/poncho travel accessory.

2. Description of the Related Art

Devices related to the present invention have been described in the related art, however, none of the related art disclose the unique features of the present invention.

In U.S. Patent Application Publication No. 2005/0262634 dated Dec. 1, 2005, Gottlieb disclosed a combination convertible blanket and pillow. In U.S. Patent Application Publication No. 2010/0059558 dated Mar. 11, 2010, Robinson, et al., disclosed a combination blanket/backpack seat cushion and hooded coat. In U.S. Patent Application Publication No. 2008/0235848 dated Oct. 2, 2008, Wilder, et al., disclosed a body comforter garment inside a pillow bed in a pillow. In U.S. Pat. No. 5,884,331 dated Mar. 23, 1999, Barajas disclosed a combination seat cushion and personal cover. In U.S. Patent Application Publication No. 2012/0144550 dated Jun. 14, 2012, Nejad disclosed a poncho style blanket with attached pillow and hood. In U.S. Pat. No. 8,464,374 dated Jun. 18, 2013, Thayer disclosed a multifunctional, convertible blanket. While these devices may be suitable for the purposes for which they were designed, they would not be as suitable for the purposes of the present invention as hereinafter described.

SUMMARY OF THE PRESENT INVENTION

The present invention discloses a travel accessory including a combination blanket/poncho/pillow system that includes a substantially rectangular shaped blanket having a hood storable in a pocket on the back thereof and having arm slits therein so that the blanket can be placed about the shoulders of a user and used either as substantially a blanket or substantially a poncho with the hood being placed over the head of the user. Arm slits are provided on each end of the blanket for receiving the arms of the user so that the hands and arms of the user can be placed through the slits so that the user can wrap the blanket around himself. Also included is an accessory pack organizer for storing items therein along with a pillow having carrying handles and back straps wherein the combination system can be carried about by the user. Also shown is a feature wherein a decorative item can be placed on the upper front portion of the hood so that the decorative item can be prominently displayed on the top of the head of the user.

An object of the present invention is to provide a pillow/blanket/poncho and accessory pack which can be used for traveling by the user as a travel accessory. A further object of the present invention is to provide a system which can be used for personalized logos in order to identify the user with a particular group, such as a sporting team. A further object of the present invention is to provide a system which includes a pillow and blanket to allow the user to sleep using the system for a pillow and for a blanket. A further object of the present invention is to provide a system which can be easily used by its user. A further object of the present invention is to provide a system which can be relatively easily and inexpensively manufactured.

The foregoing and other objects and advantages will appear from the description to follow. In the description reference is made to the accompanying drawings, which fonn a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
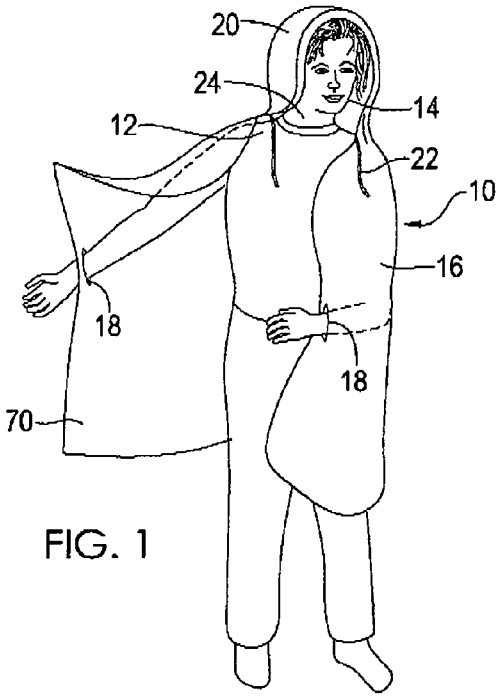
FIGS. 1 and 2 are perspective views of the present invention shown in operative connection.

With regard to reference numerals used, the following numbering is used throughout the drawings.

10 present invention
12 shoulder
14 user
16 blanket
18 arm slits
20 hood
22 strings/drawstrings
24 neck
26 bill
28 accessory pack organizer
29 pocket
30 pillow
32 carrying straps
34 back straps
35 adjustable member

36 accessory pocket
37 strip
38 space for logo
40 hook and loop material
42 pocket
43 hook and loop material
44 hook and loop material
45 hook and loop material
46 space for logo
47 hook and loop material
48 decorative item
50 base
52 first hook and loop material
54 second hook and loop material
56 princess style
58 lady bug style
60 batman style
62 one portion
64 second portion
66 direction arrow
68 space
70 inner surface
72 outer surface
74 first and
76 second end
78 first edge
80 second edge

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 11 illustrate the present invention wherein a combination pillow/blanket/poncho is disclosed which is generally indicated by reference number 10.

Figure 2:
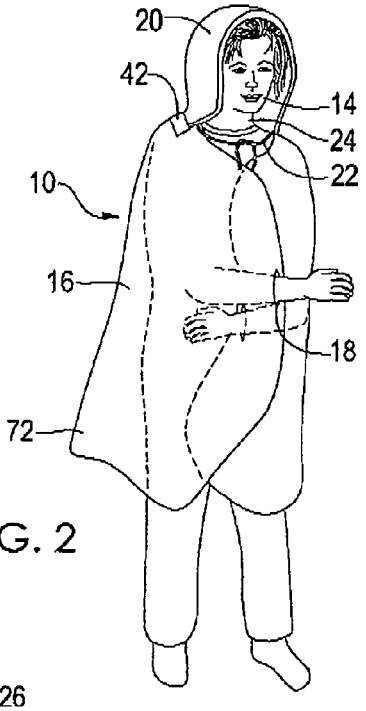

Turning to FIGS. 1 and 2, therein is shown the present invention 10 draped about the shoulders 12 of the user 14 in the form of a poncho including the blanket portion 16 having arm slits 18 on each end portion thereof along with the hood 20 shown over the head of the user wherein the hood also has strings or drawstrings 22 so that the hood can be tightened about the neck 24 of the user. A small portion of pocket 42 can also be seen in FIG. 2.

Figure 3:
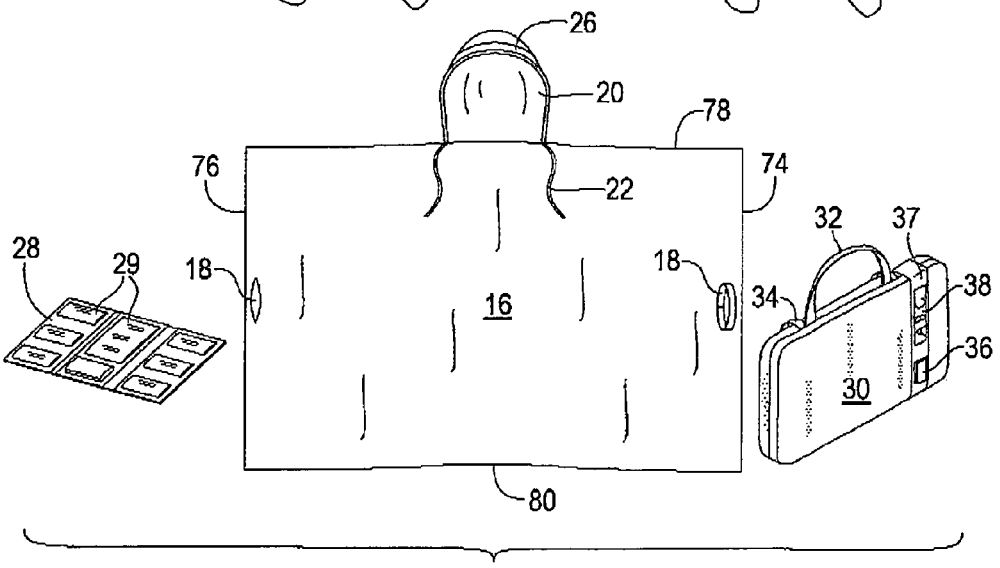
FIG. 3 is a front perspective view of individual portions of the present invention.

FIGS. 1-3 show the blanket 16 having inner surface 70, outer surface 72, first end 74, second end 76, first edge 78 and second edge 80.

Turning to FIG. 3, therein is shown portions of the present invention including a front view of the blanket 16 having means such as arm slits 18 or the like for receiving the arm of a user in each end portion thereof along with the hood 20 and its strings or drawstrings 22 and in addition, showing bill 26 on the upper front portion of the hood. Also shown is an accessory pack organizer 28 shown unfolded having a plurality of items stored in individual pockets 29 which pockets me spaced apart about one side of the pack wherein the accessory pack can also be folded so it can be stored away. Also shown is a pillow 30 for use in laying the head of the user thereon which pillow has a carrying strap 32 thereon along with left and right back straps 34 and including a strip 37 (may be a strip of cloth) having an accessory pocket portion 36 for receiving items therein and a space 38 for placement of a logo or name thereon.

Figure 4:
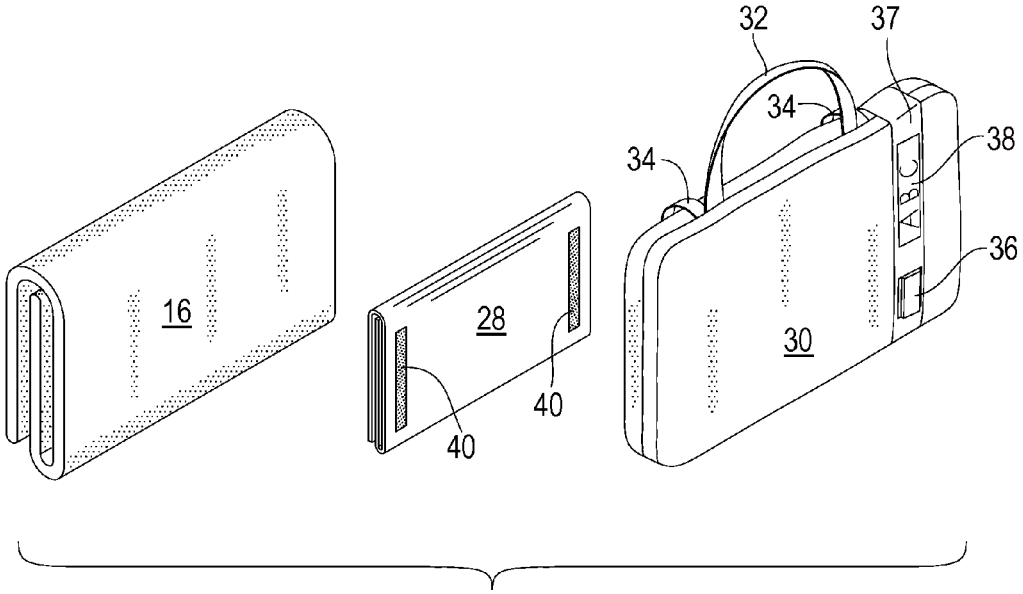
FIG. 4 is a front perspective view of individual portions of the present invention oriented for assembly as shown in FIG. 7.

Turning to FIG. 4, therein is shown a front side of the pillow 30 for use in laying the head of the user thereon which pillow has a carrying strap 32 disposed on an edge thereof along with left and right back straps 34 disposed on a back side and including strip 37 having an accessory pocket portion 36 for receiving items therein and a space 38 for placement of a logo thereon. Also shown is the accessory pack in a folded position having first and second hook and loop material 40 disposed on a back side with a blanket 16 shown in a folded position.

Figure 5:
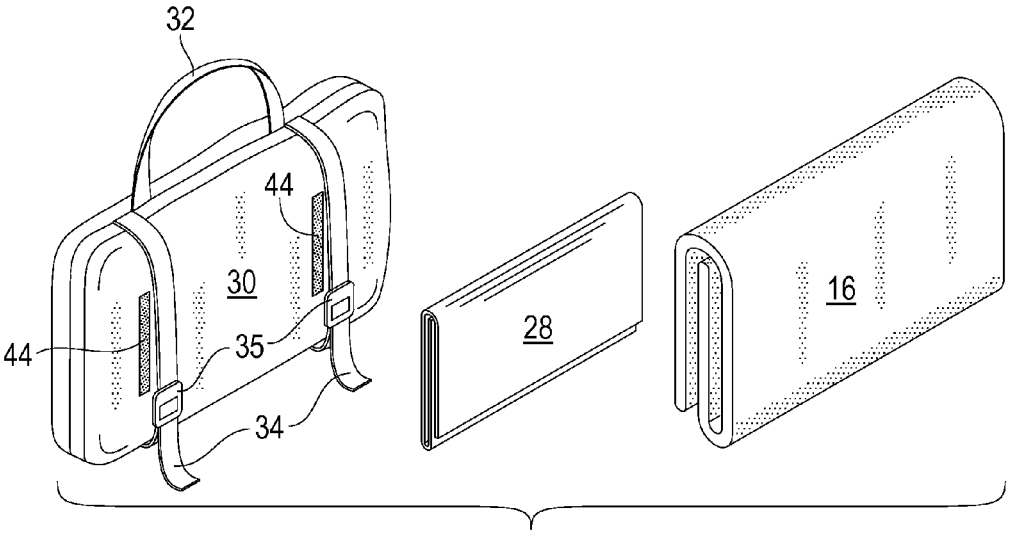
FIG. 5 is a rear perspective view of individual portions of the present invention oriented for assembly as shown in FIG. 7.

Turning to FIG. 5, therein is shown a back side of the pillow 30 for use in laying the head of the user thereon which has a carrying strap 32 thereon along with left and right back straps 34 having adjustable members 35 thereon. Also shown is the accessory pack 28 in a folded position along with a blanket 16 shown in a folded position. Also shown is mating hook and loop material 44 on the rear side of the pillow 30 which is for mating to the hook and loop material 40 which is shown on the front side of the accessory pack in FIG. 4. Also shown is carrying handle 32.

Figure 6:
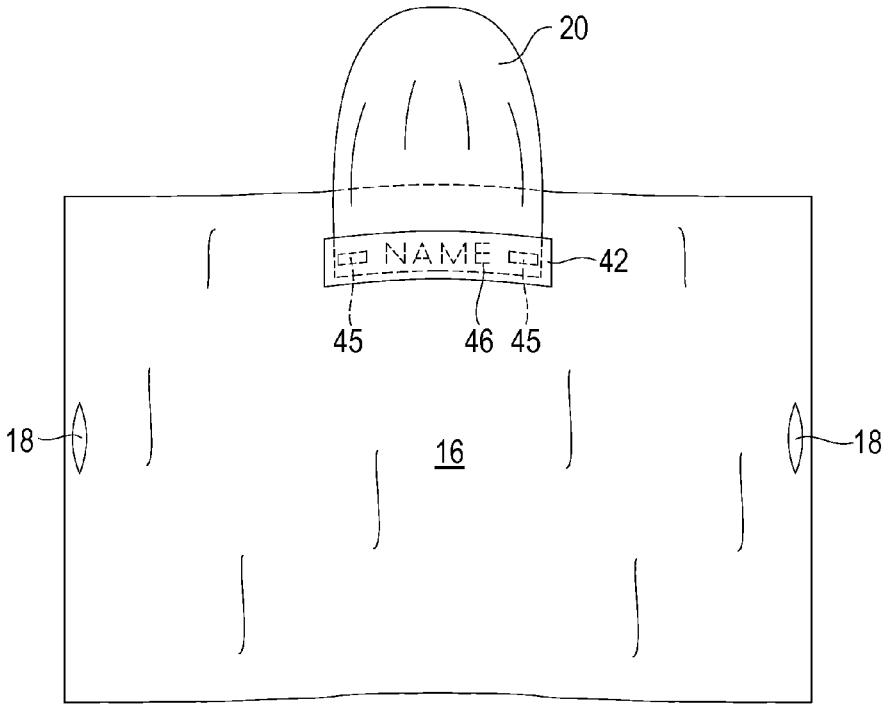
FIG. 6 is a rear perspective view of the blanket and hood portion of the present invention.

Turning to FIG. 6, therein is shown the rear side of the blanket 16 having arms slits 18 shown on each end portion thereof along with the hood 20 disposed near an upper edge of the blanket so that it can be easily placed over the head of the user. Also shown is the pocket 42 shown on the back side of the blanket 16 wherein the lower portion of the hood 20 is attached inside thereof so that the hood can be folded from the extended position as shown to a folded position inside the pocket so as to store the hood out of the way so that the blanket can be used as a substantially rectangular blanket without having the hood extended loose thereupon. Also shown is hook and loop material 45 for closing the pocket back upon itself in the standard manner using mating hook and loop material (which is not visible because its image corresponds to the image of material 45 as shown) so that the hood 20 can be secured inside pocket 42. Also shown is a space 46 whereupon a logo or name can be placed. The pocket 42 has an opening therein for receiving the hood 20 therein which pocket is oriented toward the upper edge of blanket 16.

Figure 7:
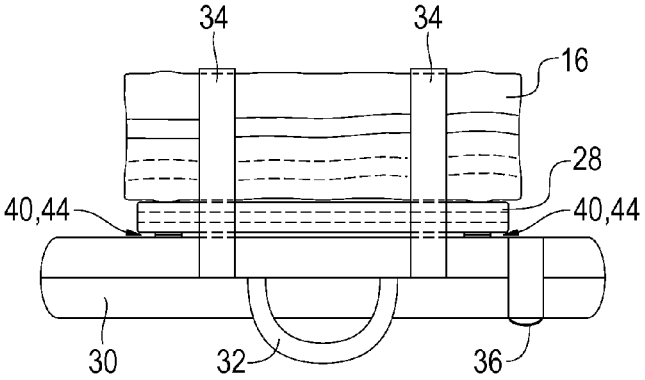
FIG. 7 is a top elevation view of portions of the present invention.

Turning to FIG. 7, therein is shown a pillow 30 with its carrying handle 32 along with accessory pocket 36 on one side thereof and folded blanket 16 on its back side wrapped in back straps 34 along with the folded accessory pack 28 placed in between the blanket and the pillow wherein the blanket and pack are held together by the back straps 34 and mating hook and loop material 40, 44.

Figure 8:
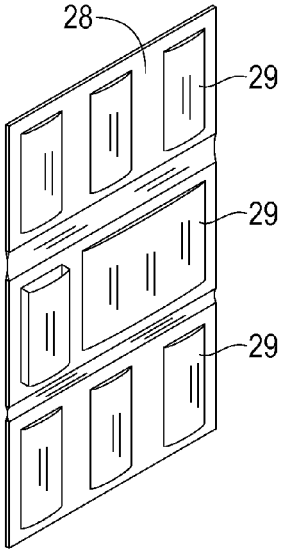
FIG. 8 is a perspective view of portions of the present invention.

Turning to FIG. 8, therein is shown the foldable accessory pack 28 along with the plurality of individual pockets 29 which may contain various types of travel accessories.

Figure 9:
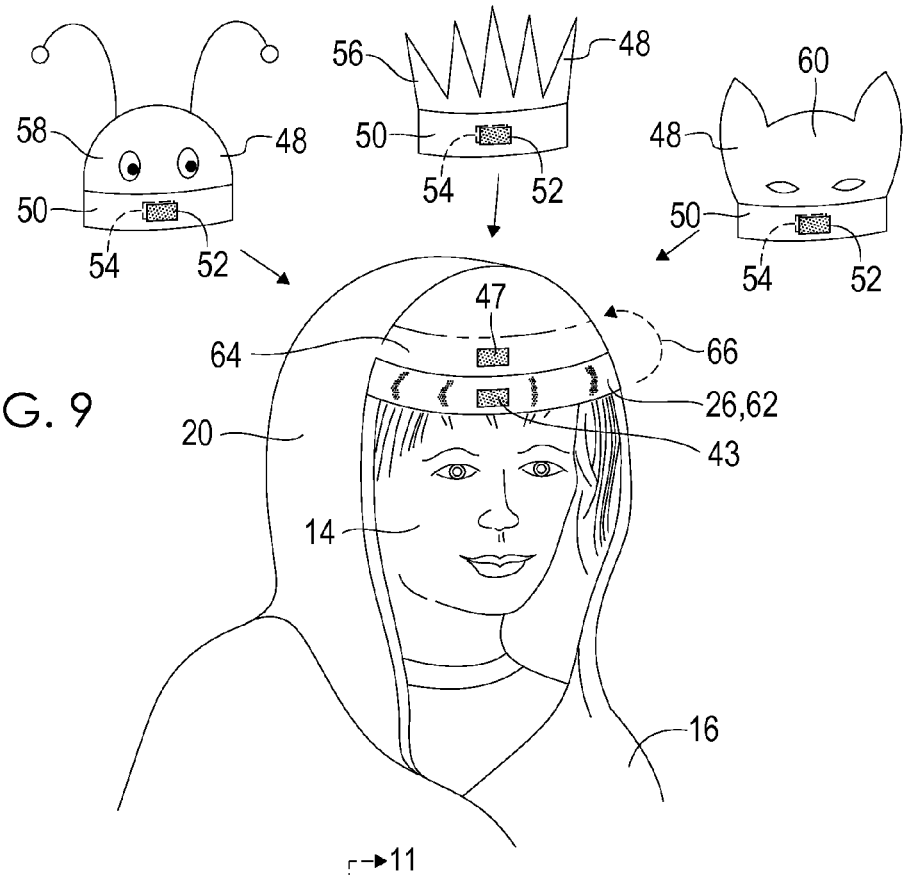
FIGS. 9 and 10 are perspective views of portions of the present invention.
Figure 11:
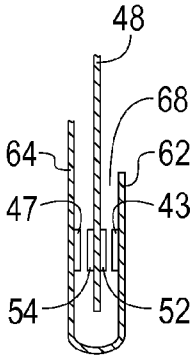
FIG. 11 is a cross-section view of the bill portion containing a decorative item taken from FIG. 10.

Turning to FIG. 9, therein is shown the user 14 having the blanket 16 and the hood 20 placed about the body of the user wherein is shown the bill 26 of the hood 20 having a first portion 62 thereof and also showing hook and loop material 43 on the bill portion and hook and loop material 47 shown on the hood portion and additionally showing direction a arrow 66 indicating that the first portion 62 of the bill 26 can be folded back upon a second portion 64 as indicated by arrows 66 so as to form a space 68 (see FIG. 11) therein wherein the base 50 of the decorative items 48 can be placed in the space so that the hook and loop material 52 on one side of the decorative item and hook and loop material 54 on the opposite side of the decorative item can be placed in the space so that it can be secured inside the space formed by the bill 26 wherein all of the hook and loop material can mate with each other in such a manner so as to secure the decorative item 48 therein as best shown in FIG. 11. The decorative item 48 can be manufactured in, for example, a princess style 56, a lady bug style 58 and a batman style 60, or the like, all of which have a base 50 and hook and loop material 52, 54 on each side of the base so that they all can be attached to the hood 20 as previously disclosed.

Figure 10:
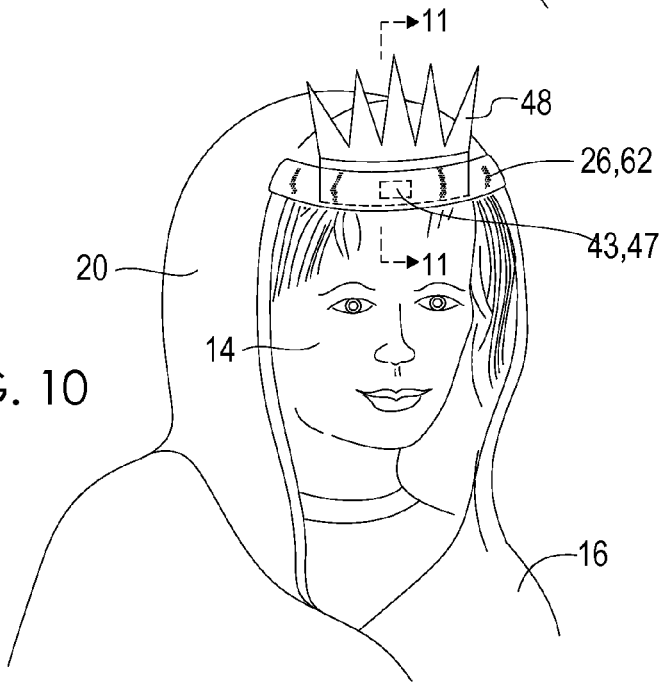

Turning to FIG. 10, therein is shown a view similar to FIG. 9 showing the blanket 16 and hood 20 draped about the user 14 wherein the bill 26 is shown in position folded back upon itself so that the decorative item 48 is captured therein and an underside of portion 62 is exposed. Also shown in hidden line is the hook and loop material 43, 47 which in this position is now hidden from sight by the exposed portion 62 of the bill 26.

Turning to FIG. 1, therein is shown the bill 26 having one portion 62 and second portion 64 with space 68 therein between and mating hook and loop material 43 and 47, along with decorative item 48 having hook and loop material 52, 54 placed in space 68.

In summary and by reference to FIG. 1-11, the pillow/blanket/poncho and accessory pack of the present invention 10 is a great travel companion for people of all ages. It is comfortable, convenient, safe and stylish rolled up in one package. The present invention 10 can be used for any travel venture including, car, plane, train, bus, storm-weather relief, camping, dorm rooms, daycare, nursery, vacation, nursing homes, naptime and costume play and serves as a great gift for many occasions (Christmas, birthdays, Mother/Father's Day, baby showers, graduation, the homeless and trips to the grandparents for the weekend). In order to prevent mistaking yours for someone else's the pillow 30 has personalization strips 38 and pocket 36 for identification, straps 32 for hand or shoulder carrying and two supporting straps 34 to carry the coordinating blanket 16. The present invention 10 is truly unique in that it is a blanket 16 or throw that can be converted to a poncho by simply pulling out a hat 20 made of soft and comfy fabric front, and rain resistance fabric on back. The blanket 16 front has two wrist slits or straps 18 located on the sides and on the back is a personalized strip pocket 42 used to store a hoodie/hat 20 inside to be used for inclement weather, business/game logos, or costume kid's play. The present invention 10 comes with a handy accessory pack 28 that's attached to the back of the pillow 30 with hook and loop fasteners 40, 44 and the pack is detachable to access the three section pockets 29 used to store incidentals, personal size items, or emergency supplies.

Product dimensions, for illustration only, follow: the pillow 30 front size is about 17"×23" shown with a handy approximate 15 to 16" a strap 32 used for hand or shoulder carrying; a personalized strip 35 with attached pocket 36 approximately sized 17"×5" for personalization or identification and to carry your favorite handheld device. The pillow 30 back also has two attached vertical straps 34 being approximate size 2"×16" used for support of coordinating blanket 16.

The blanket 16 (inside) may have two attached wrist slits or straps 18 on each side approximately 1½"×7" long. The blanket 16 size is usually about 42"×60" long (sizes vary due to small, medium, large) and the blanket back has a personalized name strip/pocket 42 being approximately sized 6"×17" with hook and loop, zipper, button or snap closure to secure and store the hoodie/hat 20 inside, which hoodie is approximate size is 13"×12". The hoodie 20 has foldable bill 26 with hook and loop fasteners used to attach logos, or costume headpiece 48.

The accessory pack 28 is approximate size 10"×17" and has a stiff or leather back cover and plastic front cover that it is divided into three pockets with hook and loop fasteners and hanging hook which may be attached at top end for convenience.

By way of summary and by reference to all the Figures, the present invention 10 discloses a system for a travel accessory including a pillow 30, blanket 16 and poncho for a user 14, the user having arms and hands, as follows: a) providing a blanket 16 having front and rear surfaces, first and second end portions, and upper and lower edge portions, the blanket having folded and unfolded positions; b) providing a pocket 42 on the rear surface, the pocket having an opening therein for receiving an item therein, wherein the pocket is oriented toward the upper edge portion; c) providing a hood 20 on the rear surface contiguous to the pocket so that the hood can be selectively configured between a folded position contained in the pocket wherein the blanket is suitable merely for use as a blanket, and an unfolded position wherein the blanket is suitable for use as a poncho, the hood having an upper front portion; d) providing a bill portion 26 on the upper front portion of the hood, wherein the bill portion has first and second portions 62, 64 having a space 68 thereinbetween, the space for receiving a decorative item 48 therein; e) securing, using means 18, the blanket to the arms of a user; f) providing a pillow 30 having front and rear side portions and an edge portion thereon, first and second straps 34 on the rear side portion of the pillow, wherein the pillow has first hook and loop material 44 on the rear side portion; g) providing an accessory pack 28 having inside and outside portions, providing a second mating hook and loop material 40 on the outside portion, providing a plurality of pockets 29 on the inside portion, each pocket having an opening therein wherein individual items can be contained within each pocket, wherein the accessory pack is selectively configurable between a folded position and an unfolded position, wherein the pockets are contained inside the accessory pack when the pack is in the folded position, wherein the pockets are exposed when the accessory pack is in the unfolded position; and, h) wherein the accessory pack when it is in the folded position can be assembled between the blanket when the blanket is in the folded position and the rear side of the pillow, so that the accessory pack, the blanket and the pillow are held together by the first and second straps, and, wherein the first and second hook and loop material mate with each other to permit the accessory pack to be secured to the pillow. Further, providing a decorative item 48 having a base 50 thereon, wherein the base can be disposed in the space for attaching the decorative item to the bill; wherein the decorative item may be configured into a characteristic style 56, 58, 60, such as a princess, and securing the decorative item to the bill using hook and loop material 43, 47, 52, 54. Further, providing first and second strings 22 on the hood for connection about a neck 24 of the user. Further, adjusting at 35 the length of the first and second straps and placing the first and second straps over a first and second shoulder 12 of the user so that the pillow can be carried on a back of the user. Further, providing a carrying strap 32 on the edge portion of the pillow for being grasped in the hand of the user for carrying the pillow about. Further, providing a strip of cloth 37 on the front of the pillow, and, a pocket 36 on the strip for carrying an item therein, and, an area 38 on the strip for displaying a logo and providing an area 46 for displaying a logo on the pocket.

I claim:

1. A travel accessory comprising a combination of a pillow, blanket convertible into a poncho and an accessory pack comprising:

a) said blanket having inner and outer surfaces, first and second end portions, and upper and lower edge portions, said blanket having folded and unfolded positions;

b) a first pocket disposed on said outer surface of said blanket, said pocket having an opening therein for receiving an item therein, wherein said pocket is oriented toward said upper edge portion of said blanket;

c) a hood extending past said upper edge portion of said blanket, a bottom edge of said hood mounted on said outer surface contiguous to said pocket so that said hood is selectively configurable between a position folded into said pocket wherein said blanket is suitable merely for use as a blanket, and an unfolded position wherein said blanket is suitable for use as a poncho, said hood being out of said pocket and having an upper front portion;

d) a bill portion disposed on said upper front portion of said hood comprising a foldable flap movable upwardly from between an open position and a closed position, respectively, forming a space for receiving a decorative item therein, and mating attachments on said hood and said foldable flap for securing said decorative item therein, said decorative item also having mating attachments on opposite sides thereof for mating with said mating attachments on said hood and foldable flap for being secured within said space, said mating attachments on said hood and foldable flap being aligned with each other;

e) wherein said blanket is adapted to be secured to the arms of a user;

f) said pillow having front and rear side portions and an edge portion thereon, first and second straps disposed on said rear side portion of said pillow, wherein said pillow has first hook and loop material disposed on said rear side portion;

g) said accessory pack having inside and outside portions, wherein a second mating hook and loop material is disposed on said outside portion, a plurality of other pockets disposed on said inside portion, each said other pocket having an opening therein wherein individual items can be contained within each said other pocket, wherein said accessory pack is selectively configurable between a folded position and an unfolded position, wherein said other pockets are contained inside said accessory pack when said pack is in said folded position, wherein said other pockets are exposed when said accessory pack is in said unfolded position; and, h) wherein said accessory pack when in said folded position can be assembled between said blanket when in said folded position and said rear side of said pillow, so that said accessory pack, said blanket and said pillow are held together by said first and second straps, and, wherein said first and second hook and loop material mate with each other to permit said accessory pack to be secured to said pillow, said travel accessory comprising said blanket, accessory pack, and pillow being thereby assembled for travel.

2. The system of claim 1, said decorative item having a base thereon, wherein said base is disposed in said space to permit said decorative item to be attached to said bill portion.

3. The system of claim 2, further comprising hook and loop material for seeming said decorative item to said bill portion.

4. The system of claim 1, further comprising first and second strings disposed on said hood for connection about a neck of the user.

5. The system of claim 1, wherein said first and second straps are adapted to be adjustable in length.

6. The system of claim 5, wherein said first and second straps can be placed over a first and second shoulder of the user and carried on a back of the user.

7. The system of claim 1, further comprising a carrying strap disposed on said edge portion of said pillow for being grasped in the hand of the user for carrying said pillow about.

8. The system of claim 1, further comprising a strip of cloth disposed on said front of said pillow, a pocket disposed on said strip for carrying an item therein, and, an area for displaying a logo disposed on said strip.

9. The system of claim 1, further comprising an area for displaying a logo disposed on said fir pocket.

10. A method for a travel accessory, said travel accessory including a pillow, blanket convertible into a poncho, and an accessory pack comprising the steps of:

a) providing said blanket having inner and outer surfaces, first and second end portions, and upper and lower edge portions, the blanket having folded and unfolded positions;

b) providing a first pocket on the outer surface, said first pocket having an opening therein for receiving an item therein, wherein said first pocket is oriented toward the upper edge portion;

c) providing a hood extending past said upper edge portion of said blanket, a bottom edge of said hood mounted on the rear surface and contiguous to the pocket so that the hood is selectively configurable between a folded position folded into said pocket wherein the blanket is suitable merely for use as a blanket, and an unfolded position wherein the blanket is suitable for use as a poncho, the hood being out of said pocket and having an upper front portion;

d) providing a bill portion on the upper front portion of the hood comprising a foldable flap movable upwardly from between an open position and a closed position, respectively, forming a space for receiving a decorative item therein, and mating attachments on said hood and said foldable flap to secure said decorative item therein, said decorative item also having mating attachments on opposite sides thereof for mating with said mating attachments on said hood and foldable flap and being secured within said space, said mating attachments on said hood and foldable flap being aligned with each other;

e) securing the blanket to the arms of a user;

f) providing said pillow having front and rear side portions and an edge portion thereon, first and second straps on the rear side portion of the pillow, wherein the pillow has first hook and loop material on the rear side portion;

g) providing said accessory peck having inside and outside portions, providing a second mating hook and loop material on the outside portion, providing a plurality of other pockets on the inside portion, each other pocket having an opening therein wherein individual items can be contained within each said other pocket, wherein the accessory pack is selectively configurable between a folded position and an unfolded position, wherein the other pockets are contained inside the accessory pack when the pack is in the folded position, wherein said other pockets are exposed when the accessory pack is in the unfolded position;

h) assembling said travel accessory by folding said accessory pack and being placed between the blanket when the blanket is in the folded position and the rear side of the pillow, so that the accessory pack, the blanket and the pillow are held together by the first and second straps, and, wherein the first and second hook and loop material mate with each other to permit the accessory pack to be secured to the pillow; and i) said user carrying said travel accessory in transit, said travel accessory being readily available when necessary for the user to rest or nap.

11. The method of claim 10, further comprising the step of providing the decorative item having a base thereon, and disposing said base in the space for attaching the decorative item to the bill portion.

12. The method of claim 11, securing the decorative item to the bill portion using hook and loop material.

13. The method of claim 10, further comprising the step of providing first and second strings on the hood for connection about a neck of the user.

14. The method of claim 10, adjusting the length of the first and second straps.

15. The method of claim 14, placing the first and second straps over a first and second shoulder of the user so that the pillow can be carried on a back of the user.

16. The method of claim 10, further comprising the step of providing a carrying strap on the edge portion of the pillow for being grasped in the hand of the user for carrying the pillow about.

17. The method of claim 10, further comprising the step of providing a strip of cloth on the front of the pillow, and, a pocket on the strip for carrying an item therein, ad an area on the strip for displaying a logo.

18. The method of claim 10, further comprising the step of providing an area for displaying a logo on the first pocket.

* * * * *